US006222153B1

(12) United States Patent
Wald

(10) Patent No.: US 6,222,153 B1
(45) Date of Patent: Apr. 24, 2001

(54) PULSED-PLASMA INCINERATION METHOD

(75) Inventor: Shlomo Wald, Rehovot (IL)

(73) Assignee: State of Israel Atomic Energy Commission Soreq Nuclear Research Center, Yavne (IL)

( * ) Notice: Subject to any disclaimer, the term of this patent is extended or adjusted under 35 U.S.C. 154(b) by 0 days.

(21) Appl. No.: 09/194,078

(22) PCT Filed: May 20, 1997

(86) PCT No.: PCT/IL97/00163

§ 371 Date: Oct. 26, 1999

§ 102(e) Date: Oct. 26, 1999

(87) PCT Pub. No.: WO97/44096

PCT Pub. Date: Nov. 27, 1997

(30) Foreign Application Priority Data

May 20, 1996 (IL) ..... 118322

(51) Int. Cl.[7] ..... B23K 10/00

(52) U.S. Cl. ..... 219/121.36; 219/121.59; 219/121.43; 219/121.48; 588/900; 110/246

(58) Field of Search ..... 219/121.44, 121.59, 219/121.36, 121.43, 121.4, 121.48; 588/212, 227, 900; 110/346, 246

(56) References Cited

U.S. PATENT DOCUMENTS

| | | | | |
|---|---|---|---|---|
| 3,494,974 | | 2/1970 | Bjorson . | |
| 4,644,877 | * | 2/1987 | Barton et al. | 110/250 |
| 5,033,355 | | 7/1991 | Goldstein et al. . | |
| 5,811,752 | * | 9/1998 | Titus et al. | 219/121.36 |

FOREIGN PATENT DOCUMENTS

WO 93/17759 9/1993 (WO) .

OTHER PUBLICATIONS

IEEE Transactions on Magnetics, vol. 25, No. 1, Jan. 1, 1989, pp. 342–346, XP000179150. Loeb A. et al., "A theoritical model for the physical processes in the confined high pressure discharges of electrothermal launchers."

Record of the Industry Applications Conference (IAS), Orlando, Oct. 8–12, 1995, vol. 2, Institute of Electrical and Electronics Engineers, pp. 1445–1452, XP000546888. Kohno, H. et al., "Destruction of volatile organic compounds used in a semiconductor industry by a capollary tube discharge reactor."

Digest of Technical Papers. Ninth IEEE International Pulsed Power Conference (Cat. No. 93CH3350–6), Proceedings of 9th International Pulsed Power Conference, Albuquerque, NM, USA, Jun. 21–23, 1993, ISBN 0–7803–1416–6, 1993, NY, pp. 180–183, vol. 1. Grothaus, M.G. et al., "Coaxial pulsed corona reactor for tratment of hazardous gases."

Arensburg, A. et al., "X–ray diagnostics of a plasma–jet–liquid interaction in electrothermal guns.", J. Appl. Phys., vol. 73 No. 5, Mar. 1, 1993, pp. 2145–2154.

* cited by examiner

*Primary Examiner*—Mark Paschall
(74) *Attorney, Agent, or Firm*—Browdy and Neimark

(57) ABSTRACT

A method for the incineration of a fluid or fluidizable material by use of a pulsed plasma is disclosed. The plasma is produced by a confined discharge in a closed chamber having an exit port and containing an ablating material. The method comprises the following steps: a) introducing the material into the chamber; and b) generating a plasma by ignition within the chamber thereby producing a flow of the plasma which incinerates the fluid material. Further described are a process for the detoxification of waste materials and a method for cracking a first compound in order to form a second compound using the method of the invention. A plasma incinerator is also described.

11 Claims, 1 Drawing Sheet

PULSED-PLASMA INCINERATION METHOD

FIELD OF THE INVENTION

Figure 1:
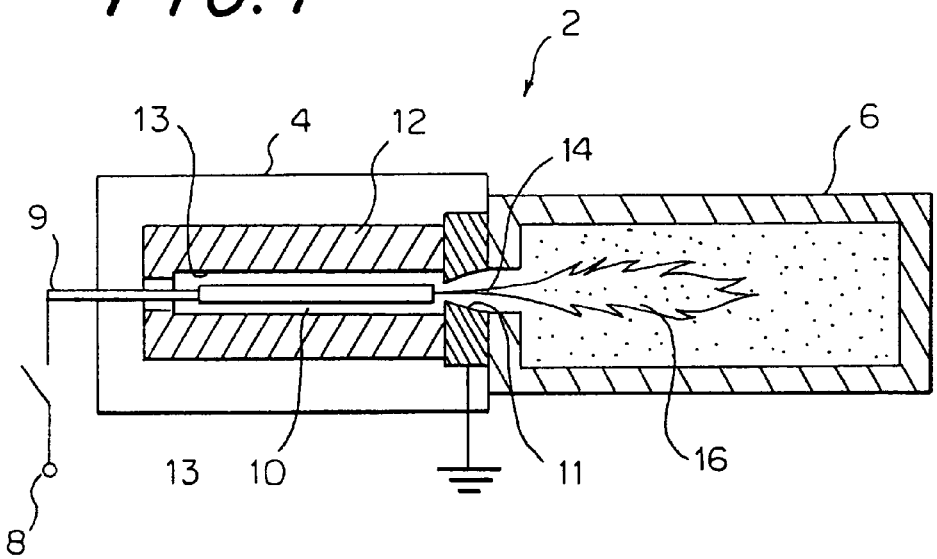

The present invention relates to the decomposition of chemicals by the use of thermal plasma, and in particular by a confined discharge pulsed plasma.

BACKGROUND OF THE INVENTION

Incineration and decomposition of chemicals by plasma have been known for over 50 years. For example, during the 1950's ethylene was produced by the cracking of hydrocarbons with plasma. Subsequently, the technology was practically abandoned by the chemical industry for a few decades.

During the past 15 years the plasma incineration of hazardous materials has once again become popular due to several factors. First of all, recent environmental concerns have raised emission standards for the destruction of hazardous materials. These standards can be followed by conventional incinerators only with great difficulty and at relatively high expense. Furthermore, there exists a wide class of organic wastes, such as halo-organic compounds, whose incineration in the presence of air can result in the production of compounds even more hazardous than the starting materials, such as phosgene, dioxins, furans and other extremely toxic gaseous substances. The treatment of such wastes by conventional pyrolysis is extremely expensive.

Furthermore, the temperature level which can be reached in combustion is limited by the adiabatic flame temperature. Since most conventional incinerators operate at 1200° C., total destruction of waste requires high retention time, post-combustion and fast quenching time, complex gas cleaning, etc. Due to all of the above factors, the use of plasma incinerators has become commercially acceptable and sometimes even the sole treatment method. By using plasma one can achieve temperatures as high as 2000–3000° C. in the treated bed so that the cracking of molecules is done faster and more efficiently. Another important aspect is that there is no need to add an oxidant agent to enable pyrolysis. This fact is important for example, for halo-organic compounds where the presence of oxygen can produce toxic substances.

Conventional plasma incinerators are generally operated in a continuous mode which will be referred to as continuous plasma incineration (CPI). The plasma is produced by a discharge in a carrier gas such as air, oxygen, nitrogen or argon so that the plasma has a very low density. Therefore, although the plasma can reach a high temperature, the effective temperature in the treated bed is in the range of 2000–3000° C. Conventional CPI incinerators are operated at a power level of a few MW.

Plasma can also be generated by pulsed-plasma incineration (PPI) in a pulsed form by confined high pressure discharge, as described for example in A. Loeb and Z. Kaplan, IEEE Transaction on Magnetics, Vol. 25, No. 1, 342 (1989), incorporated by reference. PPI has a basically different mode of operation than that of CPI devices. This method of generation very efficiently couples a large amount of electrically stored energy into the formation of a hot plasma jet. Pulses of a duration of several milliseconds and at a power level of up to 1GW can be-produced.

Furthermore, following the ignition of the discharge in a confined volume, the plasma begins to ablate the surrounding wall material. This has several important consequences. Firstly, the plasma density is greatly increased, usually up to $10^{-3}$ g/cc, due to ablated mass being added to the plasma without the need of any carrier gas. Secondly, the ablated matter cools the plasma down to 1–3 eV, and subsequently increases the device's electrical impedance. If the plasma is allowed to escape from the confined volume through an exit nozzle, steady state plasma production operation conditions can result for a steady voltage/current supply to the discharge.

Furthermore, the high density plasma jet which carries a mass in the order of 100 mg per pulse travels at a velocity in the range of 10–20 km/s. Hence, the jet carries a very high momentum.

In the CPI case, on the other hand, the plasma radiation is. absorbed by a very small amount of the treated matter or by the gases in the reactor due to the low density and the low jet momentum. Thus, the remainder of the treated bed is heated mainly by conduction and convection heat transfer mechanisms. The energy is evenly distributed to all the degrees of freedom in the treated bed. In the PPI mode the dominant mechanism is radiative heat transfer (RHT). This mechanism is generally ineffective. However, in PPI the RHT is increased by several orders of magnitude due to the propagation of the high-velocity jet in the treated bed. This is due to the fact that the surface area exposed to the radiation is substantially increased by the Rayleigh-Taylor and Kelvin-Helmholtz hydrodynamic instabilities occurring on the jet-fluid interface. This effect is described experimentally in A. Arensburg, S. Wald and S. Goldsmith, J. Appl. Phys. 73 (5) (1993), incorporated by reference.

The outcome of this effect is that a major part of the radiation directly excites specific chemical bonds within the treated materials as compared to the global excitation in the CPI case. The photon wavelength distribution is similar to that of a black body. For a typical PPI plasma most of the photons are in the range of 100–200 nm. This is in the range most relevant for the cracking of many important chemical bonds, such as halogen-carbon bonds in halo-organic compounds. Therefore, the effect of the plasma jet is more similar to photolysis processes usually carried out by UV lamps or by high intensity lasers. Laser (and UV) decomposition is well known, but it is difficult and expensive to produce a laser pulse of several milliseconds in the power range of 100 MW, which is, however, easily obtained by PPI. Furthermore, there is no plasma jet effect leading to an increase in RHT.

The incineration of chemical wastes by using pulsed plasma has been previously described in a number of publications.

U.S. Pat. No. 3,494,974 describes the pyrolysis of 1,2-dichlorotetrafluoroethane in a plasma jet to produce trifluromethane. The plasma torch in this patent is a conventional one: low-density, low power and not produced by a confined discharge. The pulsing mode is used in this patent only as a result of the sequential character of the process for the production of trifluromethane. It is therefore in truth more comparable to a CPI process.

In a recent publication by H. Kohno et.al. "Destruction of Volatile Organic Compounds Used in the Semiconductor Industry by a Capillary Tube Discharge Reactor", IEEE Trans. on Ind. Appl. (1995) pp. 1445–1452, confined discharge is used for plasma production. However, the discharge is done in a gaseous environment without the presence of any ablating material. No ablation mechanism occurs, the plasma density is low and no jet-flow momentum effects take place.

BRIEF SUMMARY OF THE INVENTION

It is an object of the present invention to provide a method for the decomposition of chemical materials.

It is a further object of the present invention to provide a method for the incineration of chemical wastes.

It is a still further object of the present invention to provide a method which overcomes the disadvantages of conventional flame incinerators, CPI and conventional photolysis.

Additionally, it is an object of the present invention to provide a device for use in the incineration of chemical wastes.

According to one aspect of the present invention, there is provided a method for the incineration of a fluid or fluidizable material by use of a pulsed plasma produced by a confined discharge in a closed chamber having an exit port and containing an ablating material, the method comprising:

(a) introducing the material into the chamber; and (b) generating a plasma by ignition within the chamber thereby producing a flow of the plasma which incinerates the fluid material, said plasma being produced by a confined discharge in said closed chamber which contains an ablating material, whereby most of the energy transfer from the plasma to said fluid or fluidizable material is by radiation.

In this specification, the term incineration includes various dissociative processes including decomposition, vitrification, pyrolysis and cracking. These terms will at times be used interchangeably.

Further in accordance with this aspect of the present invention, there is provided a method in which the closed chamber comprises an injector compartment and a reactor compartment, and wherein the compartments are connected through an aperture.

In a preferred embodiment of the present invention, the ablating material comprises the fluid material.

According to another aspect of the invention, there is provided a plasma incinerator for use in the method of the invention comprising: 1) a power supply; 2) a closed chamber surrounded by walls made of ablating materials having an exit port, and adapted for use as plasma injector compartment; 3) a material feeding system; 4) an exhaust gas handling system; and 5) a non-gaseous product handling system.

The pulsed-plasma jet is produced in a confined discharge plasma injector device. Reactions take place in the plasma injector zone and/or in a reaction chamber attached to the plasma injector. The reactor can be under vacuum or underpressurized, but due to the momentum of the plasma the interface area between the treated bed and the jet can even reach super-critical pressure. Therefore, chemical reaction rates can be highly increased. Moreover, the quenching time is very short.

The jet impinges directly on the treated matter. Most of the energy transfer is by radiation. The photon wavelength distribution is similar to that of a black body, in the range of 100–200 nm. This is the range of the relevant chemical bonds to be cracked, such as halogen-carbon bonds.

The RFT is increased by several orders of magnitude due to the propagation of the high-velocity jet in the treated bed. Thus, the advantage of the method of the invention resides in the combination of the following aspects: 1) the hydrodynamic effect due to the momentum of the jet; 2) the high radiation transfer; and 3) the high power output.

In a preferred embodiment, the ablating materials used for the control of the confined discharge parameters can be the compound which is to be treated. In this way, the cost of cooling the system is reduced. Additives can be added to the treated materials in order to control the products. Such additives can include gases such as oxygen, nitrogen or air, and any other fluid catalytic materials. Exhaust gas handling systems and non-gaseous product handling systems can be attached to the incinerator. The combination of several or all these elements allow for the treatment of any fluid material: gas, liquid, sludge, powder, etc., or, a solid that can be transferred to a fluid form due to the jet impact. The method of the invention is especially useful in the incineration of organic compounds, although inorganic compounds are also amenable to the method.

In the event that large amount of hydrocarbons, or water-metal mixtures exist in the pyrolysis a large amount of hot hydrogen is produced. The hydrogen can be used in further chemical processes. The facility in this way may be considered as an energetic hydrogen generator.

BRIEF DESCRIPTION OF TEE DRAWINGS

Figure 2:
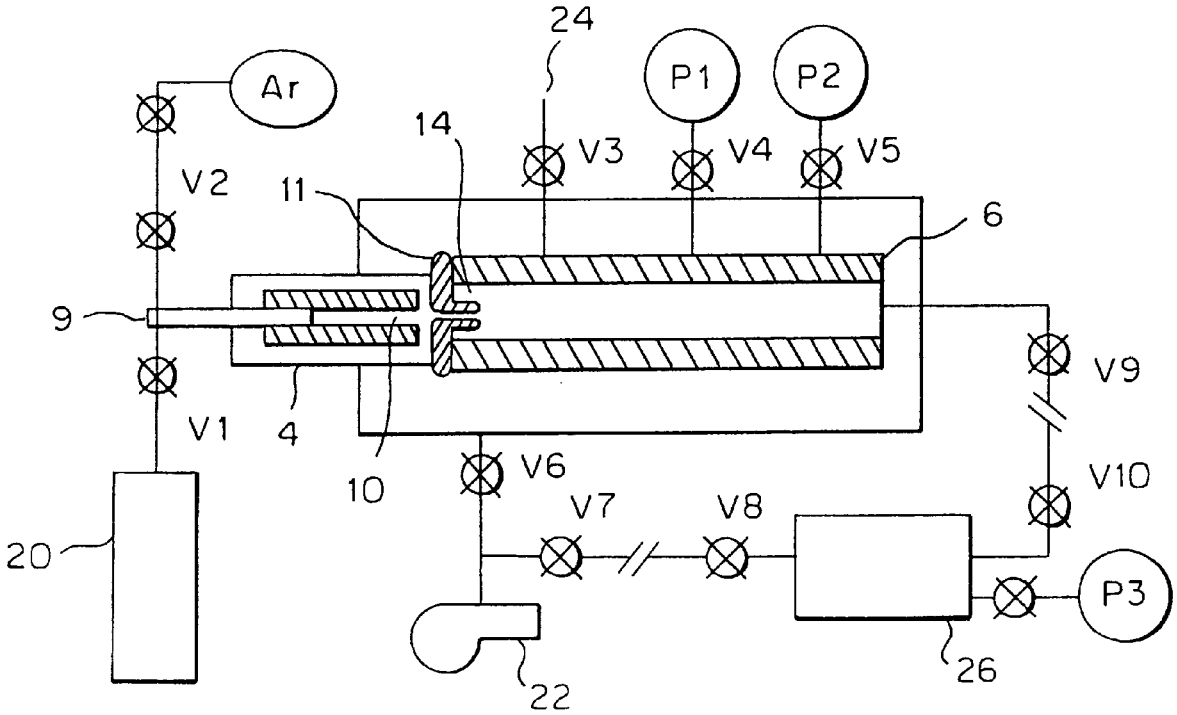

The present invention will be better understood from the following detailed description of preferred embodiments, taken in conjunction with the following drawings in which:

FIG. 1 is a schematic side sectional view of an incinerating device for use in one embodiment of the method of the invention; and FIG. 2 is a block diagram illustrating one embodiment of the method of the invention.

DETAILED DESCRIPTION OF A PREFERRED EMBODIMENT

The confined high pressure discharges can very efficiently couple a target amount of electrically stored energy into the formation of hot plasma jets at a temperature of several eV.

When the plasma is formed by an electrical discharge in a confined volume it is cooled down due to the ablation of the chamber's walls. Hence, the plasma is formed out of the ablating material molecules. Its density is restricted by the flow rate of the plasma through the exit port of the confined volume. An example of a cylindrical plasma injector design and its typical characteristics are given in Loeb and Kaplan, supra.

FIG. 1 shows a preferred embodiment of a pulsed plasma incinerator, generally designated 2, comprising a plasma injector compartment 4 and a reactor compartment 6 connected through exit port 14. A power supply 8 is connected to the plasma injector compartment 4 and can be a capacitor based pulse-forming network. The power supply includes energy storage and switching elements.

The plasma injector 4 has a confined space 10 surrounded by ablative walls 12. A hollow anode 9 is positioned at one end of the confined space and a cathode 11 at the opposite end proximate to the reactor. The port 14 is in the form of an aperture which perforates the center of the cathode. The shape of the exit port as well as the size and shape of the confined space are among the factors which determine the properties of the plasma. These parameters can be determined by the skilled man of the art with reference to the scientific literature, for example Loeb and Kaplan, supra.

Materials with proper dielectric and thermal properties, such as high density polyethylene, can be used as ablating materials in the incinerator. In addition, the treated material and/or other additives can be applied to the inner surface 13 of the injector walls 12 to be used as an ablating material in the injector. The choice of a proper ablating material and the amount of mass ablated per pulse can be determined by the skilled man of the art with reference to the scientific literature, for example Loeb and Kaplan, supra. In the event that the treated material itself is used as an ablating material the ablation process provides a self cooling system for the injector. Otherwise, an external cooling system, e.g. a water heat-exchanger, may be required to reduce the heat load on the injector during continuous operation.

The incinerator will generally include a material feeding system (not shown) to insert a batch of the treated material into the injector and/or the reactor. The feeding method of the material depends on its nature—solid or fluid, and on its electrical properties. In the example of FIG. 1, the treated material can be fed into the incinerator through the anode 9.

The material in the confined space is ignited, e.g. by an electrical discharge, and the plasma formed in the plasma injector compartment flows through the injector compartment 4 and port 14 into the reactor 6 in the form of a plasma jet 16. If the batch is small enough the reactor is not essential and it is sufficient to connect gas and non-gaseous product handling systems to the plasma injector compartment which enable the fast quenching of the products, etc. However, more frequently, part or all of the treated material is introduced into the reactor and most of the incineration process occurs in it. In such a case, a gas handling system and a non-gas handling system are generally connected to the reactor through an exit port (not shown) for the collection and further treatment of exhaust gases and incineration products.

The efficiency of the RHT in the treated material bed is enhanced by several orders of magnitude, in comparison with laser or UV illumination. This is due to the fact that the surface area exposed to the radiation is substantially increased by the hydrodynamic instabilities caused by the plasma jet. This effect is described experimentally in A. Arensburg, supra.

An additional application of the method of the invention is Br and Cl recovery from many halo-organic compounds such as PCB etc.

EXAMPLE

A schematic drawing of a laboratory test setup, used for 1,2 di-chloroethane (DCE) decomposition, is shown in FIG. 2. As in FIG. 1, the incinerator comprises an injector compartment 4 and a reactor compartment 6. The discharge takes place between a hollow anode 9 and a cathode 11 which is located at the reactor end of the confined space 10. The exit port 14 extends through the cathode as in FIG. 1. The injector 4 and reactor compartments 6 are pumped by the pump 22 through the valve V6. The DCE can be introduced through the material feeding system 20, the valve V1 and the anode 9 into the injector's chamber 10 and/or directly into the reactor through the injection port 24 and valve V3. Additives such as an additional ignition gas can be introduced as well through the valve V2.

Gas is collected through valve V9 into a gas handling system 26 using at cold trap and subsequently treated. Pressure gauges P1–P3 are used to control and monitor the process.

For the specific DCE experiment described above, the DCE was manufactured by Fluka AG, Switzerland. Most of the experiments were carried out with 1–2 g DCE batches. The DCE vapor pressure was sufficient for the injector ignition. Therefore, no other ignition gas, such as argon, was necessary.

In the present example, the DCE was injected through V1 (and the anode 9) and also served as an ablator for the plasma production. In an alternative configuration, the DCE is injected through the injection port 24 and valve V3, and the plasma is produced by the ablation of the plasma injector walls which are made from a high density polyethylene (HDPE) tube. Most of the experiments were carried out with 5 kJ/g of electrical energy.

Samples of the gas products were tested. Hydrogen was the dominant product (around 90%). Other traceable materials were methane, chlorine and HCl. No measurable quantity of any chlorine compound (beside HCl) was observed. The solid residues of the carbon ashes were tested with a TGA (Thermogravimetric Analyzer) and no polymers such as PVC were detected (besides small amounts of residues from the HDPE tube). No DCE, PVC, VC or other materials were absorbed in the ash.

Since the energy level of the chlorine chemical bonds in DCE is approximately 3 eV, the injector is designed in such a way that most of the photons in the plasma are in this range. The outcome is an efficient energy transfer to the chlorine bonds which are to be broken. In this experiment less than 5 MJ/kg were needed for total decomposition of the DCE.

Typical plasma characteristics are summarized in Table I:

TABLE I

| Parameter | Typical values | DCE experiment |
|---|---|---|
| a. Pulse duration: | milliseconds range | 0.5–1 ms |
| b. Energy per pulse: | 10 kJ–1 MJ | 5–20 kJ |
| c. Power: | 10 MW–1 GW | 10–50 MW |
| d. Plasma temperature: | 1–5 eV | 1–3 eV |
| e. Plasma density: | $10^{-4}$–$10^{-3}$ g/cm$^3$ | ~5 × $10^{-4}$ g/cm$^3$ |
| f. Plasma jet velocity: | 5–20 km/s | ~10 km/s |

It will be appreciated by persons skilled in the art that the present invention is not limited to what has been thus far described, but rather the scope of the present invention is limited only by the following claims:

What is claimed is:

1. A method for the incineration of a fluid or fluidizable material by a pulsed plasma, said method comprising:

(a) introducing said material into a closed chamber having an exit port; and (b) generating a plasma by ignition within said chamber thereby producing a flow of said plasma which incinerates said fluid material, said plasma being produced by a confined discharge in said closed chamber which contains an ablating material, wherein:

(i) the plasma temperature is in the range of from about 1 eV to about 5 eV;

(ii) the plasma density is higher than about $10^{-5}$ g/cm$^3$; and In re of WALD=1

(iii) the plasma jet velocity is higher than about 2 km/s, so as to ensure that a major fraction of the energy transfer from the plasma to said fluid or fluidizable material is by radiation, characterized in that the spectrum of the photon wavelength radiation of said pulsed plasma encompasses the chemical bond energy range of said fluid or fluidizable material.

2. A method according to claim 1 wherein said closed chamber comprises an injector compartment and a reactor compartment, and wherein said compartments are connected through an aperture.

3. A method according to claim 1 wherein in step (a) an additive is also introduced into said chamber.

4. A method according to claim 3 wherein said additive is selected from the group consisting of oxygen, nitrogen and air.

5. A method according to claim 1 wherein said plasma is generated from said fluid or fluidizable material.

6. A method according to claim 1 wherein said incineration is carried out without the use of an oxidant.

7. A method according to claim 1 wherein said material is a halogenated organic compound.

8. A method according to claim 1 used for the detoxification of waste materials.

9. A method according to claim 1 used for cracking a first compound in order to form a second compound comprising treating said first compound according to said method so as to form said second compound.

10. A plasma incinerator for use in the method of claim 1 comprising:

(a) a power supply (b) a closed chamber having an exit port, being surrounded by walls made of ablating material and adapted for use as a plasma injector compartment;

(c) a material feeding system;

(d) an exhaust gas handling system; and (e) a non-gaseous product handling system.

11. A plasma incinerator according to claim 10 further comprising a reactor compartment connected to said plasma injector by a nozzle.

* * * * *